US011976828B2

(12) United States Patent
Sakata et al.

(10) Patent No.: US 11,976,828 B2
(45) Date of Patent: May 7, 2024

(54) OUTDOOR UNIT OF AIR-CONDITIONING APPARATUS

(71) Applicant: Mitsubishi Electric Corporation, Tokyo (JP)

(72) Inventors: Kohei Sakata, Tokyo (JP); Shigeru Hata, Tokyo (JP)

(73) Assignee: Mitsubishi Electric Corporation, Tokyo (JP)

( * ) Notice: Subject to any disclaimer, the term of this patent is extended or adjusted under 35 U.S.C. 154(b) by 122 days.

(21) Appl. No.: 17/795,418

(22) PCT Filed: Mar. 30, 2020

(86) PCT No.: PCT/JP2020/014543
§ 371 (c)(1),
(2) Date: Jul. 26, 2022

(87) PCT Pub. No.: WO2021/199155
PCT Pub. Date: Oct. 7, 2021

(65) Prior Publication Data

US 2023/0049872 A1 Feb. 16, 2023

(51) Int. Cl.
*F24F 1/58* (2011.01)
*F24F 1/24* (2011.01)
(Continued)

(52) U.S. Cl.
CPC ..... *F24F 1/58* (2013.01); *F24F 1/24* (2013.01); *F24F 1/68* (2013.01); *F24F 11/88* (2018.01);
(Continued)

(58) Field of Classification Search
CPC .... F24F 1/0003; F24F 1/06; F24F 1/22; F24F 1/24; F24F 1/34; F24F 1/56; F24F 1/58;
(Continued)

(56) References Cited

U.S. PATENT DOCUMENTS

2003/0042010 A1* 3/2003 Kobayashi ..... F24F 13/20 165/122
2008/0011001 A1* 1/2008 Katsuyama ..... F24F 1/22 62/77
(Continued)

FOREIGN PATENT DOCUMENTS

JP 2003074904 A * 3/2003 ..... F24F 1/027
JP 2006-046830 A 2/2006
(Continued)

OTHER PUBLICATIONS

International Search Report of the International Searching Authority dated Jun. 23, 2020 for the corresponding International application No. PCT/JP2020/014543 (and English translation).

*Primary Examiner* — Joseph F Trpisovsky
(74) *Attorney, Agent, or Firm* — POSZ LAW GROUP, PLC

(57) ABSTRACT

An outdoor unit of an air-conditioning apparatus in which indoor units are connected, includes: a housing forming an outer casing of the outdoor unit; a terminal block located at a side of the housing; and a conduit plate to be attached to the terminal block. The conduit plate includes: a terminal block cover to be attached to the housing to cover the terminal block, and having an opening portion formed at a lower portion of the terminal block cover; an outer casing cover to be attached to the terminal block cover to cover the opening portion of the terminal block cover, and having an opening portion at a side of the outer casing cover; and a cable connection cover to be attached to the side of the outer casing cover, and having attachment holes for connection of a conduit cable to be connected to the terminal block.

4 Claims, 4 Drawing Sheets

(51) Int. Cl.

| | |
|---|---|
| ***F24F 1/68*** | (2011.01) |
| ***F24F 11/88*** | (2018.01) |
| ***F24F 11/89*** | (2018.01) |
| ***F24F 13/20*** | (2006.01) |

(52) U.S. Cl.
CPC ..... *F24F 11/89* (2018.01); *F24F 13/20* (2013.01); *F24F 2013/207* (2013.01)

(58) Field of Classification Search
CPC .... F24F 1/68; F24F 11/88; F24F 13/20; F24F 2013/207; F24F 2221/54
See application file for complete search history.

(56) References Cited

U.S. PATENT DOCUMENTS

| | | | | |
|---|---|---|---|---|
| 2017/0314793 | A1* | 11/2017 | Jinnai ..... | F24F 1/34 |
| 2017/0363303 | A1* | 12/2017 | Jinnai ..... | F24F 1/22 |
| 2019/0271477 | A1* | 9/2019 | Takeuchi ..... | F24F 1/56 |
| 2019/0285288 | A1* | 9/2019 | Watanabe ..... | F24F 1/22 |

FOREIGN PATENT DOCUMENTS

| | | | | | |
|---|---|---|---|---|---|
| JP | 2013217600 | A | * | 10/2013 | |
| JP | 2017096577 | A | * | 6/2017 | |
| WO | WO-2016203542 | A1 | * | 12/2016 ..... | F24F 1/22 |

* cited by examiner

OUTDOOR UNIT OF AIR-CONDITIONING APPARATUS

CROSS REFERENCE TO RELATED APPLICATION

This application is a U.S. national stage application of PCT/JP2020/014543 filed on Mar. 30, 2020 the contents of which are incorporated herein by reference.

TECHNICAL FIELD

The present disclosure relates to an outdoor unit for use in an air-conditioning apparatus.

BACKGROUND ART

As an example of an existing outdoor unit, an outdoor unit described in Patent Literature 1 is known. This outdoor unit is used in an air-conditioning apparatus. A plurality of electric wires are connected, as conduit cables that cover conduits, to various electrical components provided in the outdoor unit. The electric wires are also used for supplying power.

The conduit cables are fixed to a conduit plate that is a sheet metal component. The conduit plate is provided below a terminal block located at a side of the outdoor unit and above refrigerant pipes that are connected to an indoor unit. The conduit plate has through holes in its side surface. The conduit cables are inserted through the through holes and the electric wires are connected to the terminal block. The conduit plate is fixed to a terminal-block attachment plate. The terminal block and the electric wires are covered by the conduit plate and the terminal-block attachment plate.

CITATION LIST

Patent Literature

Patent Literature 1: Japanese Unexamined Patent Application Publication No. 2006-046830

SUMMARY OF INVENTION

Technical Problem

It should be noted that in each of multi-split air-conditioning apparatuses in which a plurality of indoor units are connected to a single outdoor unit, a plurality of refrigerant pipes connected to the outdoor unit are arranged in an up-down direction and extend to a region located immediately below a terminal block. Furthermore, each of the refrigerant pipes is extended to a back side of a housing of the outdoor unit. Consequently, in some cases, conduit cables could not be provided in a region where a common conduit plate is located; that is, the conduit cables could not be connected to the terminal block from a region located below a terminal block cover.

Even in the above case, the conduit plate can still be provided in a region located beside the terminal block cover. However, when the connection position of the conduit cables is located side by side with the terminal block, there is a possibility that under adverse weather conditions, drops of, for example, rain water blown against the conduit plate from the back side of the housing of the outdoor unit will enter through a gap or gaps in the conduit plate. In this case, there is apprehension that the drops that have entered through the gap in the conduit plate may stick to the terminal block and thus create problems in the operation of the outdoor unit. In addition, it is difficult to connect the electric wires to the terminal block from the connection portion of the conduit cables, which are arranged relative to the terminal block in the lateral direction, that is, in the horizontal direction. That is, this connection cannot be easily performed.

The present disclosure is applied to solve the above problems, and relates to an outdoor unit of an air-conditioning apparatus, in which it is prevent drops of water from entering through a gap in a conduit plate, and thus prevent the water drops from sticking to a terminal block.

Solution to Problem

An outdoor unit of an air-conditioning apparatus according to an embodiment of the present disclosure is an outdoor unit of an air-conditioning apparatus in which a plurality of indoor units are connected. The outdoor unit includes: a housing that forms an outer casing of the outdoor unit; a terminal block located at a side of the housing; and a conduit plate to be attached to the terminal block. The conduit plate includes: a terminal block cover to be attached to the housing to cover the terminal block, and having an opening portion formed at a lower portion of the terminal block cover; an outer casing cover to be attached to the terminal block cover to cover the opening portion of the terminal block cover, the outer casing cover having an opening portion at a side of the outer casing cover: and a cable connection cover to be attached to the side of the outer casing cover, and having a plurality of attachment holes for connection of conduit cables to be connected to the terminal block.

Advantageous Effects of Invention

In the outdoor unit of the air-conditioning apparatus according to the embodiment of the present disclosure, the conduit plate to be attached to the terminal block includes the terminal block cover to be attached to the housing to cover the terminal block, and having the opening portion formed at the lower portion of the terminal block cover, the outer casing cover to be attached to the terminal block cover to cover the opening portion of the terminal block cover, and the cable connection cover to be attached to the side of the outer casing cover, and having the plurality of attachment holes for the conduit cables to be connected to the terminal block. By virtue of the above configuration, the terminal block cover and the outer casing cover can prevent drops of water from entering through a gap in the conduit plate, and also prevent the drops of water from sticking to the terminal block.

DESCRIPTION OF EMBODIMENTS

Embodiments of the present disclosure will be described with reference to the drawings. It should be noted that the configurations of the components described in the entire text of the specification are each merely an example, and the description concerning the configurations is not limiting. That is, the present disclosure can be appropriately changed without departing from the gist or concept of the present disclosure that can be read from the claims and the entire specification. The outdoor unit of an air-conditioning apparatus as described in the disclosure changed in the above manner is also covered by the technical concept of the present disclosure. In addition, in each of figures that will be referred to below, components that are the same as or equivalent to those in a previous figure or previous figures are denoted by the same reference signs, and the same is true of the entire text of the specification.

Embodiment 1

<Configuration of Air-Conditioning Apparatus 1>

Figure 1:
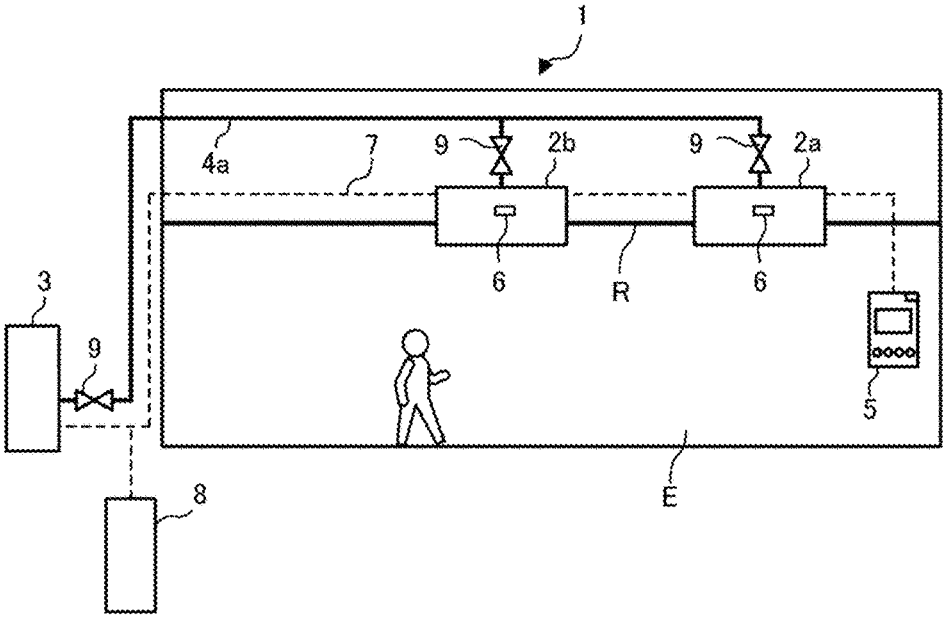
FIG. 1 is an explanatory view illustrating an example of the setting of an air-conditioning apparatus according to Embodiment 1.

FIG. 1 is an explanatory view illustrating an example of the setting of an air-conditioning apparatus 1 according to Embodiment 1. As illustrated in FIG. 1, in the air-conditioning apparatus 1 according to Embodiment 1, a plurality of indoor units 2*a* and 2*b* are connected to an outdoor unit 3 by refrigerant pipes 4*a* and 4*b* through which refrigerant flows. It should be noted that regarding the indoor units 2*a* and 2*b*, a single indoor unit or a plurality of indoor units are provided for the outdoor unit 3; however, in Embodiment 1, two indoor units are provided for the outdoor unit, whereby a multi-split air-conditioning apparatus 1 is provided. Furthermore, since the indoor units 2*a* and 2*b* have the same configuration, only the indoor unit 2*a* is illustrated in the figures, except for FIG. 1, and will be described, for the sake of convenience. Likewise, regarding the refrigerant pipes 4*a* and 4*b*, only the refrigerant pipe 4*a* is illustrated in FIG. 1, and will be described.

The indoor units 2*a* and 2*b* are installed, for example, on a ceiling surface R in a room E that is an air-conditioned space. It should be noted that the indoor units 2*a* and 2*b* may be installed in the same room E, or may be installed in respective rooms. Furthermore, one of the indoor units 2*a* and 2*b* or both the indoor units 2*a* and 2*b* are installed in a single room, that is, the room E. In addition, the indoor units 2*a* and 2*b* may be of a two-direction blow type or of a four-direction blow type. Various types of indoor units that are other than the above types can be widely applicable.

Furthermore, in Embodiment 1, the indoor units 2*a* and 2*b* are provided with respective controllers 6 that are connected to a wired remote control unit 5 by wires 7. The remote control unit 5 is operable by a user in order to make detailed settings on the indoor unit, such as the settings of "on/off" operation, temperature, flow rate of wind, wind direction, and timer. The remote control unit 5 is also connected to the outdoor unit 3 by a wire 7. It should be noted that the remote control unit 5 is not limited to the wired remote control unit, but may be a wireless remote control unit, or both the wired remote control unit and the wireless remote control unit may be provided. The controllers 6 are further connected to a management device 8 by a wire 7. The management device 8 manages the operating state of the air-conditioning apparatus 1.

Furthermore, at the refrigerant pipes 4*a* and 4*b* connecting the indoor units 2*a* and 2*b* to the outdoor unit 3, refrigerant-pipe connection valves 9 are provided. More specifically, the refrigerant-pipe connection valves 9 are provided at connection portions of the refrigerant pipes 4*a* and 4*b* with the indoor units 2*a* and 2*b* and with the outdoor unit 3.

<Refrigerant Circuit>

Figure 2:
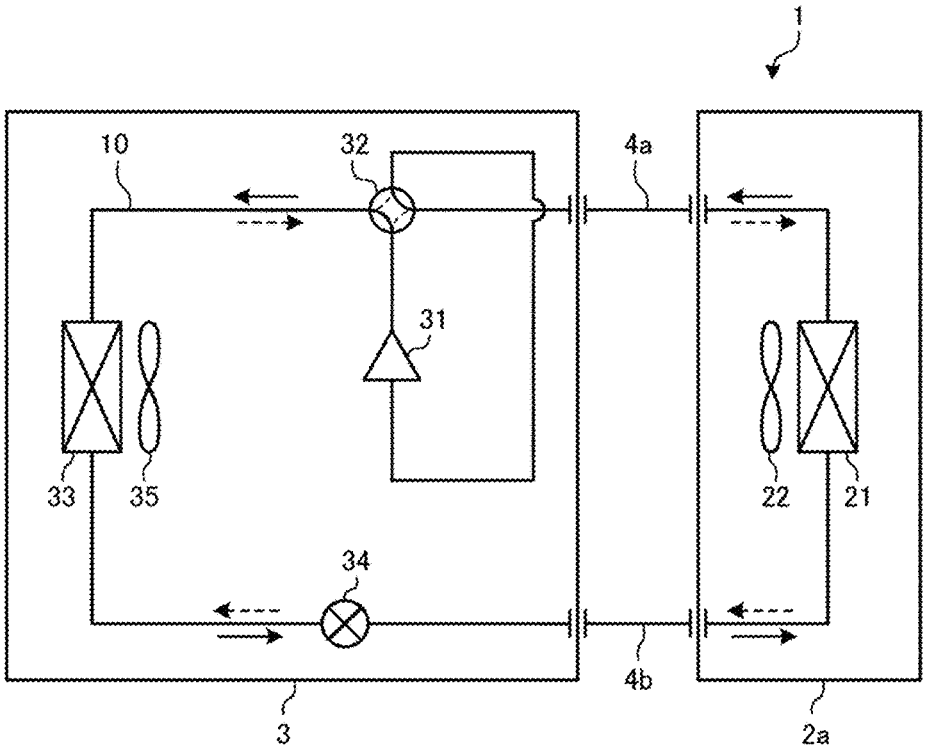
FIG. 2 is a schematic diagram illustrating a refrigerant circuit of the air-conditioning apparatus according to Embodiment 1.

FIG. 2 is a schematic diagram illustrating a refrigerant circuit 10 of the air-conditioning apparatus 1 according to Embodiment 1. It should be noted that since the indoor units 2*a* and 2*b* have the same configuration, only the indoor unit 2*a* is illustrated in FIG. 2 and will be described for the sake of convenience. As illustrated in FIG. 2, the air-conditioning apparatus 1 causes heat to be transferred between outside air and indoor air through refrigerant, thereby heating or cooling the room to condition air in the room. The air-conditioning apparatus 1 includes the outdoor unit 3 and the indoor unit 2*a*.

In the air-conditioning apparatus 1, the outdoor unit 3 is connected to the indoor unit 2*a* by the refrigerant pipes 4*a* and 4*b*, whereby the refrigerant circuit 10 is formed in which refrigerant circulates. In the refrigerant circuit 10 of the air-conditioning apparatus 1, a compressor 31, a flow switching device 32, an outdoor heat exchanger 33, an expansion valve 34, and an indoor heat exchanger 21 are connected by the refrigerant pipes 4*a* and 4*b*.

The outdoor unit 3 includes the compressor 31, the flow switching device 32, the outdoor heat exchanger 33, and the expansion valve 34. The compressor 31 compresses sucked refrigerant and discharges the compressed refrigerant. The compressor 31 may include an inverter device, and may be configured to cause the inverter device to vary an operation frequency of the compressor 31 to change the capacity thereof. It should be noted that the capacity of the compressor 31 corresponds to the amount of refrigerant to be sent per unit time. The flow switching device 32 is, for example, a four-way valve, and configured to change a flow passage for the refrigerant, that is, the flow direction of the refrigerant.

Based on an instruction from the controller (see FIG. 1), the air-conditioning apparatus 1 changes the flow direction of refrigerant by use of the flow switching device 32, to thereby perform heating operation or cooling operation. The outdoor heat exchanger 33 causes heat exchange to be performed between refrigerant and outdoor air. In heating operation, the outdoor heat exchanger 33 serves as an evaporator. The outdoor heat exchanger 33 causes heat exchange to be performed between outdoor air and low-pressure refrigerant that has flowed from the refrigerant pipe 4*b* into the outdoor heat exchanger 33, to thereby evaporate and vaporize the refrigerant, and then causes the refrigerant to flow out of the outdoor heat exchanger 33 toward the refrigerant pipe 4*a*. In cooling operation, the outdoor heat exchanger 33 serves as a condenser. The outdoor heat exchanger 33 causes heat exchange to be performed between outdoor air and refrigerant that has already been compressed in the compressor 31 and flowed from the flow switching device 32 into the outdoor heat exchanger 33, to thereby condense and liquefy the refrigerant. The outdoor heat exchanger 33 is provided with an outdoor fan 35 to increase the efficiency of heat exchange between refrigerant and outdoor air. The outdoor fan 35 may include an inverter device that provided therein, and the inverter device may vary the operation frequency of a fan motor to change the rotational speed of the fan. The expansion valve 34 is an expansion device (flow-rate control module). The expansion valve 34 adjusts the flow rate of refrigerant that flows in the expansion valve 34, thus operating as an expansion valve, and adjusts the pressure of refrigerant by varying the opening degree of the expansion valve 34. For example, in the case where the expansion valve 34 is an electronic expansion valve, the opening degree of the expansion valve 34 is adjusted based on an instruction from the controller 6 or other controllers.

The indoor unit 2*a* includes an indoor heat exchanger 21 and a fan 22. The indoor heat exchanger 21 causes heat exchange to be performed between refrigerant and indoor air. The fan 22 adjusts the flow of air that is subjected to the heat exchange at the indoor heat exchanger 21.

In heating operation, the indoor heat exchanger 21 operates as a condenser. The indoor heat exchanger 21 causes heat exchange to be performed between indoor air and refrigerant that has flowed from the refrigerant pipe 4*a* into the indoor heat exchanger 21, thereby condensing and liquefying the refrigerant, and then causes the refrigerant to flow out of the indoor heat exchanger 21 toward the refrigerant pipe 4*b*. In cooling operation, the indoor heat exchanger 21 operates as an evaporator. The indoor heat exchanger 21 causes heat exchange to be performed between indoor air and refrigerant that has been made to be in a low-pressure state by the expansion valve 34, thereby causing the refrigerant to receive heat of the air to evaporate and vaporize, and then causes the refrigerant to flow out of the indoor heat exchanger 21 toward the refrigerant pipe 4*a*. The operational speed of the fan 22 is determined by settings made by the user. The fan 22 may include an inverter device, and the operation frequency of the fan motor may be varied in order to change the rotation speed of the fan.

Examples of Cooling Operation and Heating Operation of Air-Conditioning Apparatus 1

Next, cooling operation of the air-conditioning apparatus 1 will be described as an example of the operation of the air-conditioning apparatus 1. High-temperature high-pressure gas refrigerant that is obtained by compression by the compressor 31 and is then discharged from the compressor 31 flows into the outdoor heat exchanger 33 via the flow switching device 32. The gas refrigerant that has flowed into the outdoor heat exchanger 33 exchanges heat with outside air sent by the outdoor fan 35 to condense and thus change into low-temperature refrigerant. The low-temperature refrigerant then flows out of the outdoor heat exchanger 33. The refrigerant that has flowed out of the outdoor heat exchanger 33 is expanded and reduced in pressure by the expansion valve 34 to change into low-temperature low-pressure two-phase gas-liquid refrigerant. This two-phase gas-liquid refrigerant flows into the indoor heat exchanger 21 in the indoor unit 2*a*, and exchanges heat with indoor air sent by the fan 22 to evaporate and thus change into low-temperature low-pressure gas refrigerant. The low-temperature low-pressure gas refrigerant then flows out of the indoor heat exchanger 21. At this time, the refrigerant receives heat from the indoor air, and the indoor air is thus cooled and is then blown as conditioned air (blowing air) from the indoor unit 2*a* toward the room E (see FIG. 1) that is the air-conditioned space. The gas refrigerant that has flowed out of the indoor heat exchanger 21 is sucked into the compressor 31 via the flow switching device 32 and is re-compressed in the compressor 31. In the cooling operation of the air-conditioning apparatus 1, the above cycle of operation is repeated (as indicated by solid arrows in the figure).

Next, heating operation will be described as another example of the operation of the air-conditioning apparatus 1. High-temperature high-pressure gas refrigerant that is obtained by compression by the compressor 31 and then discharged from the compressor 31 flows into the indoor heat exchanger 21 in the indoor unit 2*a* via the flow switching device 32. The gas refrigerant that has flowed into the indoor heat exchanger 21 exchanges heat with indoor air sent by the fan 22 to condense and thus change into low-temperature refrigerant. The low-temperature refrigerant then flows out of the indoor heat exchanger 21. At this time, the indoor air receives heat from the gas refrigerant, and is thereby heated and then blown as conditioned air (blowing air). from the indoor unit 2*a* toward the room E (see FIG. 1). The refrigerant that has flowed out of the indoor heat exchanger 21 is expanded and reduced in pressure by the expansion valve 34 to change into low-temperature low-pressure two-phase gas-liquid refrigerant. This two-phase gas-liquid refrigerant flows into the outdoor heat exchanger 33 in the outdoor unit 3, and exchanges heat with outside air sent by the outdoor fan 35 to evaporate and thus change into low-temperature low-pressure gas refrigerant. The low-temperature low-pressure gas refrigerant then flows out of the outdoor heat exchanger 33. The gas refrigerant that has flowed out of the outdoor heat exchanger 33 is sucked into the compressor 31 via the flow switching device 32 and is re-compressed in the compressor 31. In the heating operation of the air-conditioning apparatus 1, the above cycle of operation is repeated (indicated by dotted arrows in the figure).

<Configuration of Outdoor Unit 3>

Figure 3:
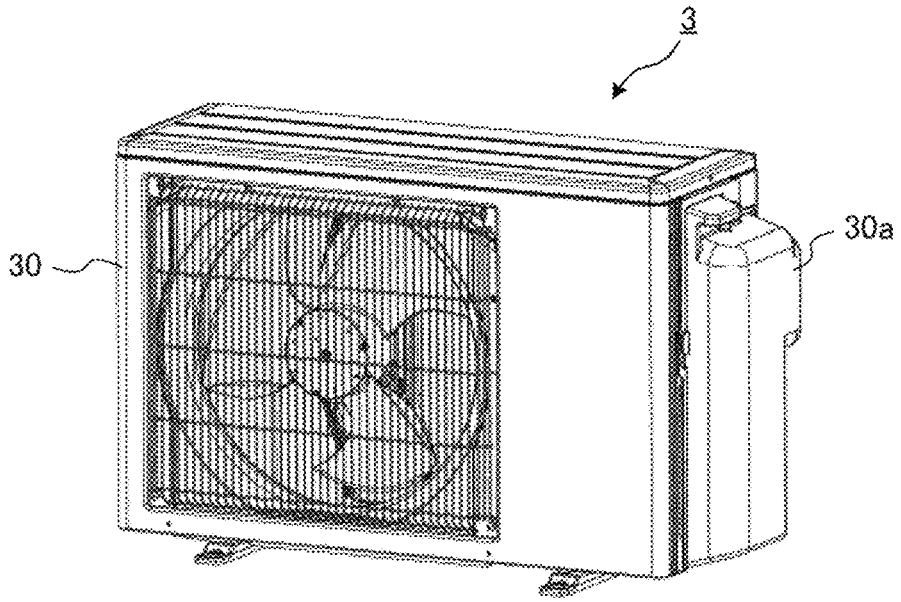
FIG. 3 is a perspective view illustrating an external appearance of an outdoor unit according to Embodiment 1.
Figure 4:
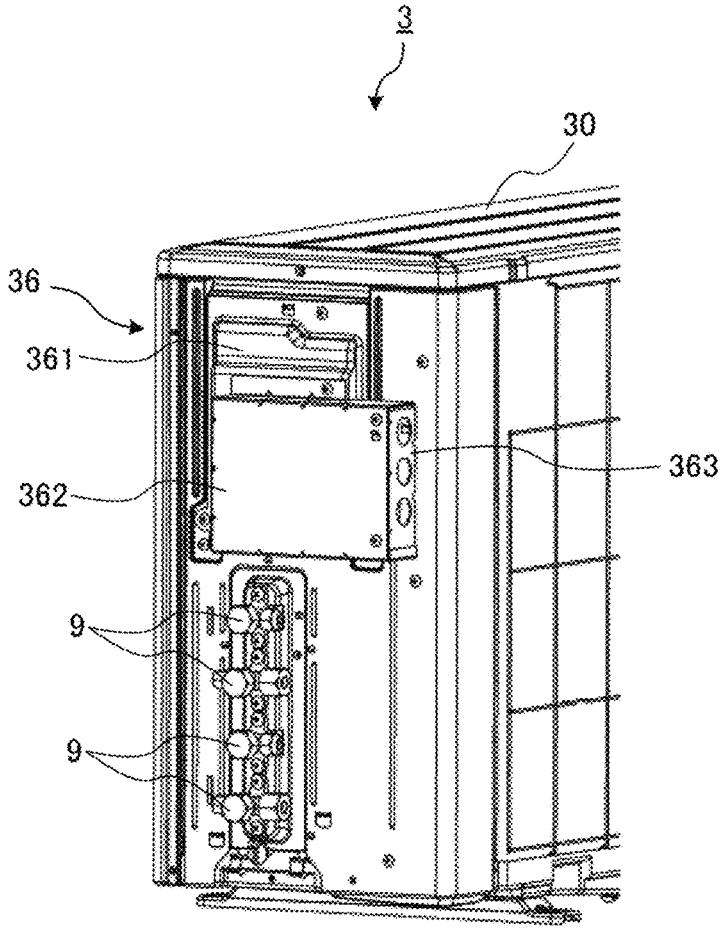
FIG. 4 is a perspective view illustrating a conduit plate provided at a side of the outdoor unit as illustrated in FIG. 3.
Figure 5:
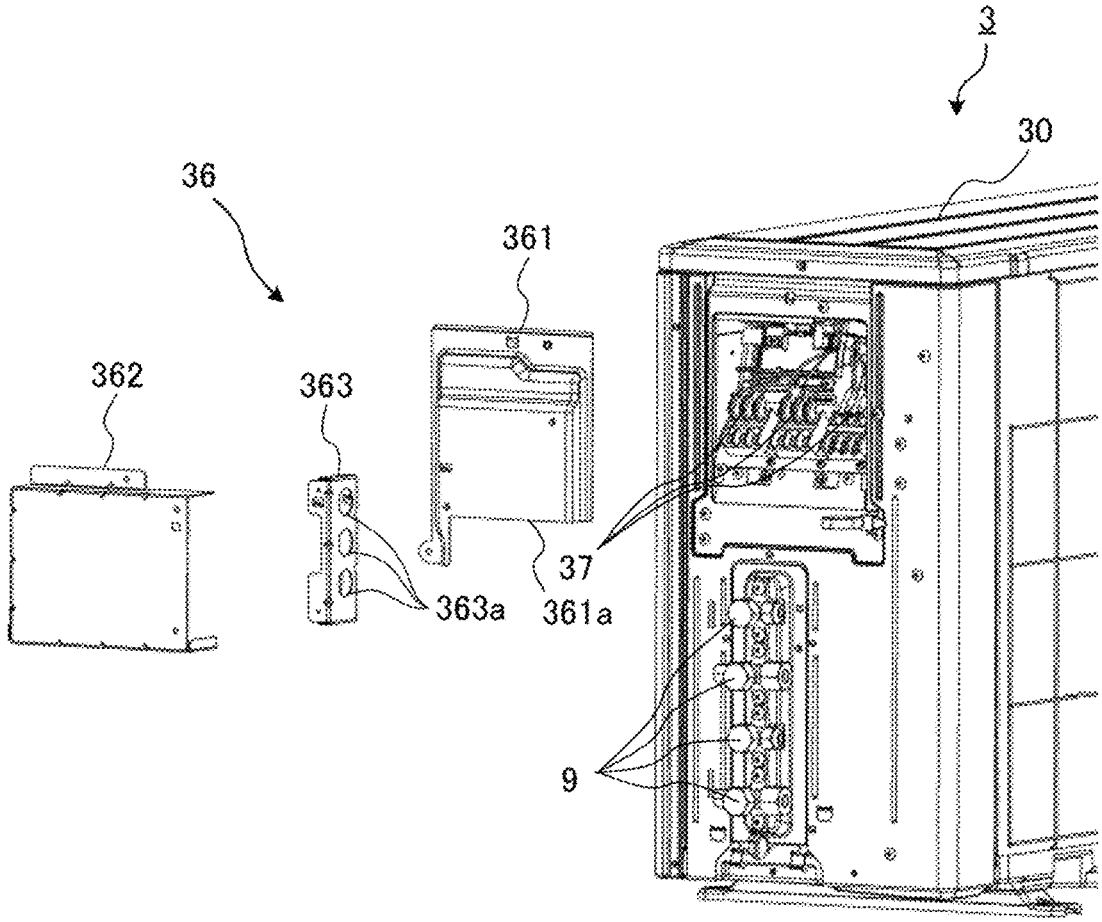
FIG. 5 is an exploded perspective view illustrating the conduit plate as illustrated in FIG. 4.
Figure 6:
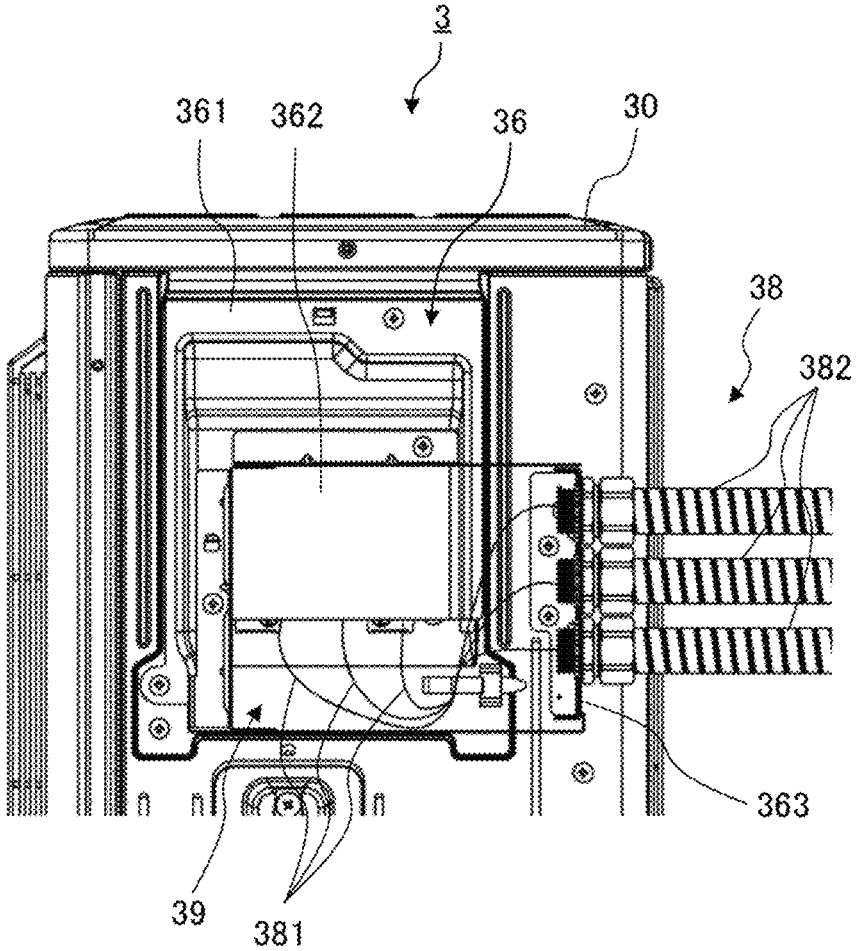
FIG. 6 is a plan view illustrating the conduit plate provided at the side of the outdoor unit as illustrated in FIG. 3.

With reference to FIGS. 3 to 6, the outdoor unit 3 according to Embodiment 1 will be described. FIG. 3 is a perspective view illustrating an external appearance of the outdoor unit 3 according to Embodiment 1. FIG. 4 is a perspective view illustrating a conduit plate 36 provided at a side of the outdoor unit 3 as illustrated in FIG. 3. FIG. 5 is an exploded perspective view illustrating the conduit plate 36 as illustrated in FIG. 4. FIG. 6 is a plan view illustrating the conduit plate 36 provided at the side of the outdoor unit 3 as illustrated in FIG. 3. It should be noted that in FIG. 6, an outer casing cover 362 is illustrated as a transparent one as a matter of convenience for explanation.

As illustrated in FIGS. 3 to 6, the outdoor unit 3 according to Embodiment 1 includes a housing 30 that forms an outer casing, a terminal block 37 located at the side of the housing 30, and the conduit plate 36 that is attached to the terminal block 37. The housing 30 includes a side cover 30*a* that is detachably attached to the side of the housing 30 by fixing members such as screws. The terminal block 37 and the conduit plate 36 are covered by the side cover 30*a*, and are thereby accommodated in an internal space inward of the side cover 30*a* and prevented from being exposed to outside air. The housing 30 is formed in the shape of a cuboid. The conduit plate 36 is detachably attached to the housing 30 by fixing members such as screws.

The conduit plate 36 includes a terminal block cover 361 and the outer casing cover 362. The terminal block cover 361 is attached to the housing 30 in such a manner as to cover the terminal block 37, and has an opening portion formed at a lower portion of the terminal block cover 361. The outer casing cover 362 is attached to the terminal block cover 361 to cover an opening portion 361*a* of the terminal block cover 361. A surface of the terminal block cover 361 that faces the terminal block 37 has such a shape as to bulge in the opposite direction to a direction toward the terminal block 37, whereby the opening portion 361*a* is formed at the lower portion of the terminal block cover 361.

The conduit plate 36 further includes a cable connection cover 363. The cable connection cover 363 is attached to a side of the outer casing cover 362, and has a plurality of attachment holes 363*a* for conduit cables 38 to be connected to the terminal block 37. The outer casing cover 362 is formed in the shape of a rectangular box having an open side surface and an open surface that faces the terminal block cover 361. The cable connection cover 363 is attached to the open side surface of the outer casing cover 362. The conduit cables 38 are attached to the plurality of attachment holes 363*a* of the cable connection cover 363.

The conduit cables 38 includes electric wires 381 and conduits 382. The electric wires 381 are to be connected through the terminal block 37 to electrical components (not illustrated) provided in the housing 30, and the conduits 382 cover the electric wires 381.

In the cable connection cover 363, at least one of the attachment holes 363*a* is located at a higher position than a lower end of the terminal block 37 in the height direction of the cable connection cover 363. Therefore, the cable connection cover 363 is located at a higher position than the refrigerant-pipe connection valves 9. Thus, even in the multi-split air-conditioning system, which are provided with a plurality of sets of refrigerant pipes, the conduit plate 36 can be attached.

A space 39 is provided between the lower end of the terminal block cover 361 in the height direction and the lower end of the outer casing cover 362 in the height direction. The space 39 is surrounded by the terminal block cover 361, the outer casing cover 362, and the side of the housing 30. In the space 39, the electric wires 381 of the conduit cables 38 are partially located. In such a manner, since the electric wires 381 are partially located in the space 39, the electric wires 381 of the conduit cables 38 attached to the attachment holes 363*a* of the cable connection cover 363 can be easily connected to the terminal block 37.

As illustrated in FIG. 5, at the side of the housing 30, in an area located below the terminal block 37, the refrigerant-pipe connection valves 9 are arranged in the up-down direction. The refrigerant-pipe connection valves 9 are to be connected to the refrigerant pipes 4*a* and 4*b* located in the outdoor unit 3. A lower end portion of the outer casing cover 362, which is attached to the housing 30 to cover the terminal block 37, is located in a surrounding area of the refrigerant-pipe connection valves 9. In such a manner, a lower end portion of the outer casing cover 362 is located in a region located close to the refrigerant-pipe connection valves 9. Thus, the electric wires 381 can be easily connected to the terminal block 37.

Advantages of Embodiment 1

As explained above, in the outdoor unit 3 according to Embodiment 1, the conduit plate 36 to be attached to the terminal block 37 includes the terminal block cover 361, the outer casing cover 362, and the cable connection cover 363. The terminal block cover 361 is attached to the housing 30 to cover the terminal block 37, and has an opening portion that is formed at a lower portion of the terminal block cover 361. The outer casing cover 362 is attached to the terminal block cover 361 to cover the opening portion 361*a* of the terminal block cover 361. The cable connection cover 363 is attached to the side of the outer casing cover 362, and has the attachment holes 363*a* for the conduit cables 38 to be connected to the terminal block 37. Because of provision of the above configuration, the terminal block cover 361 and the outer casing cover 362 can prevent drops of water from entering through the gap in the conduit plate 36, and thus prevent the drops of water from sticking to the terminal block 37. In addition, since the conduit plate 36 has the above configuration, even in the multi-spilt air-conditioning system in which the indoor units 2*a* and 2*b* are connected, the conduit cables 38 can be easily connected without changing the attachment position of the conduit plate 36.

Moreover, at least one of the attachment holes 363*a* provided in the cable connection cover 363 is located at a higher position than the lower end of the terminal block 37 in the height direction. Therefore, the cable connection cover 363 is located at a higher position than the refrigerant-pipe connection valves 9. Thus, even in the multi-split air-conditioning system in which a plurality of sets of refrigerant pipes are provided, the conduit plate 36 can be attached.

Furthermore, the space 39 is formed between the lower end portion of the terminal block cover 361 in the height direction and the lower end portion of the outer casing cover 362 in the height direction. The space 39 is surrounded by the terminal block cover 361, the outer casing cover 362, and the side of the housing 30. Since the electric wires 381 of the conduit cable 38 are partially located in the space 39, the electric wires 381 of the conduit cable 38 that are attached to the attachment holes 363*a* of the cable connection cover 363 can be easily connected to the terminal block 37. Furthermore, since the electric wires 381 are partially located in the space 39, the electric wires 381 are not exposed to the outside, and it is therefore possible to prevent direct contact with the electric wires 381 from the outside. Thus, the electric wires 381 can be prevented from being broken or damaged. Not only that, since the conduit plate 36 is detachably attached to the housing 30, the maintenance of the outdoor unit 3 is also improved.

REFERENCE SIGNS LIST

1: air-conditioning apparatus, 2*a*: indoor unit, 2*b*: indoor unit, 3: outdoor unit, 30: housing, 30*a*: side cover, 31: compressor, 32: flow switching device, 33: outdoor heat exchanger, 34: expansion valve, 35: outdoor fan, 36: conduit plate, 361: terminal block cover, 361*a*: opening portion, 362: outer casing cover, 363: cable connection cover, 363*a*: attachment hole, 37: terminal block, 38: conduit cable, 381: electric wire, 382: conduit, 39: space, 4*a*: refrigerant pipe, 4*b*: refrigerant pipe, 5: remote control unit, 6: controller, 7: wire, 8: management device, 9: refrigerant-pipe connection valve, 10: refrigerant circuit, 13: controller, 21: indoor heat exchanger, 22: fan, E: room, R: ceiling surface

The invention claimed is:

1. An outdoor unit of an air-conditioning apparatus in which a plurality of indoor units are connected, the outdoor unit comprising:

a housing forming an outer casing of the outdoor unit;

a terminal block located at a side of the housing; and a conduit plate to be attached to the terminal block, wherein the conduit plate includes a terminal block cover to be attached to the housing to cover the terminal block, and having an opening portion formed at a lower portion of the terminal block cover, an outer casing cover to be attached to the terminal block cover to cover the opening portion of the terminal block cover, the outer casing cover having an opening portion at a side of the outer casing cover, and a cable connection cover to be attached to the side of the outer casing cover, and having a plurality of attachment holes for connection of conduit cables to be connected to the terminal block.

2. The outdoor unit of an air-conditioning apparatus of claim 1, wherein at the cable connection cover, at least one of the plurality of attachment holes is located at a higher position than a lower end of the terminal block in a height direction.

3. The outdoor unit of an air-conditioning apparatus of claim 1, wherein a space is provided between a lower end portion of the terminal block cover in a height direction thereof and a lower end portion of the outer casing cover in a height direction thereof, the space being surrounded by the terminal block cover, the outer casing cover, and the side of the housing, and an electric wire of a conduit cable to be connected to the terminal block is partially located in the space.

4. The outdoor unit of an air-conditioning apparatus of claim 1, wherein refrigerant-pipe connection valves are provided at the side of the housing and below the terminal block, and the lower end portion of the outer casing cover is located in a region close to the refrigerant-pipe connection valves.

* * * * *